US008579838B2

(12) United States Patent
Jang et al.

(10) Patent No.: US 8,579,838 B2
(45) Date of Patent: Nov. 12, 2013

(54) MULTI-SENSOR SIGNAL PROCESSING SYSTEM FOR DETECTING WALKING INTENT, WALKING SUPPORTING APPARATUS COMPRISING THE SYSTEM AND METHOD FOR CONTROLLING THE APPARATUS

(75) Inventors: Eun Hye Jang, Daejeon (KR); Young Jo Cho, Seongnam (KR); Jae Yeon Lee, Daejeon (KR); Su Young Chi, Daejeon (KR); Byung Tae Chun, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 325 days.

(21) Appl. No.: 12/970,538

(22) Filed: Dec. 16, 2010

(65) Prior Publication Data

US 2011/0152732 A1 Jun. 23, 2011

(30) Foreign Application Priority Data

Dec. 21, 2009 (KR) ..... 10-2009-0127698
Mar. 22, 2010 (KR) ..... 10-2010-0025356

(51) Int. Cl.
*A61H 1/00* (2006.01)
*A61H 1/02* (2006.01)
*A61H 5/00* (2006.01)

(52) U.S. Cl.
USPC ..... 601/35; 601/5

(58) Field of Classification Search
USPC ..... 601/5, 23, 27, 29–36
See application file for complete search history.

(56) References Cited

U.S. PATENT DOCUMENTS

| | | | | |
|---|---|---|---|---|
| 7,901,368 | B2 * | 3/2011 | Flaherty et al. | 601/5 |
| 8,257,232 | B2 * | 9/2012 | Albert | 482/69 |
| 2004/0143198 | A1 * | 7/2004 | West | 601/5 |
| 2008/0243265 | A1 * | 10/2008 | Lanier et al. | 623/24 |
| 2008/0249740 | A1 * | 10/2008 | Verhaert | 702/160 |
| 2011/0105966 | A1 * | 5/2011 | Kazerooni et al. | 601/35 |
| 2012/0165709 | A1 * | 6/2012 | Goffer et al. | 601/34 |

FOREIGN PATENT DOCUMENTS

| | | | |
|---|---|---|---|
| KR | 10-2005-0121049 | A | 12/2005 |
| KR | 100841177 | B1 | 6/2008 |

* cited by examiner

*Primary Examiner* — Kristen Matter

(57) ABSTRACT

Provided is a walking supporting apparatus for supporting a user walking by using a multi-sensor signal processing system that detects a walking intent. A palm sensor unit detects a force applied to a palm through a stick to generate a palm sensor signal. A sensor unit detects a force applied to a sole through the ground to generate a sole sensor signal. A portable information processing unit checks a user's walking intent by using the palm sensor signal, and if it is checked that the user has a walking intent, the portable information processing unit generates a driving signal in response to the sole sensor signal. A walking supporting mechanism includes a left motor attached to a user's left leg and a right motor attached to a user's right leg to support the user's walking when the left and right motors are driven in response to the driving signal.

20 Claims, 6 Drawing Sheets

FIG. 6
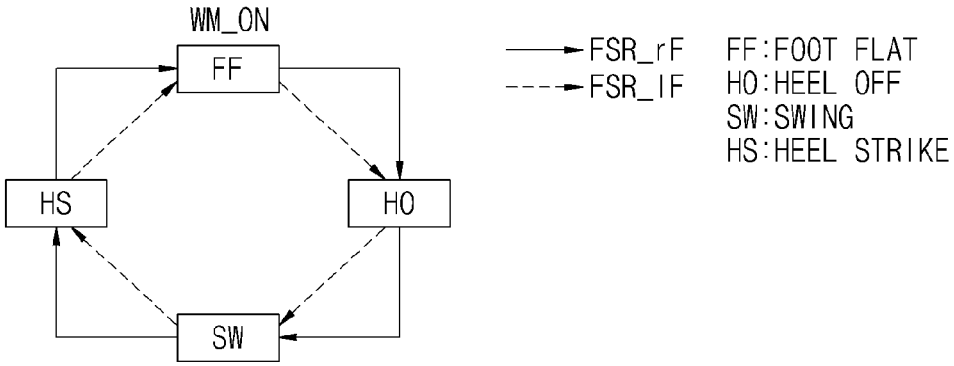
Fig. 6(a)
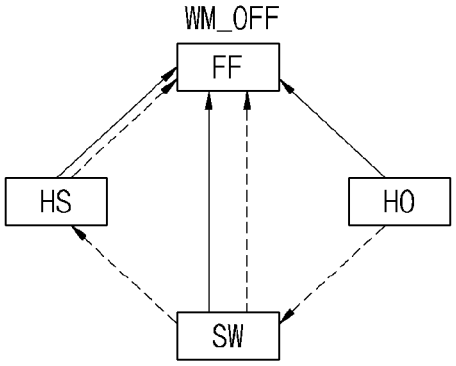
Fig. 6(b)

MULTI-SENSOR SIGNAL PROCESSING SYSTEM FOR DETECTING WALKING INTENT, WALKING SUPPORTING APPARATUS COMPRISING THE SYSTEM AND METHOD FOR CONTROLLING THE APPARATUS

CROSS-REFERENCE TO RELATED APPLICATIONS

This application claims priority under 35 U.S.C. §119 to Korean Patent Application No. 10-2009-0127698, filed on Dec. 21, 2009, and Korean Patent Application No. 10-2010-0025356, filed on Mar. 22, 2010 in the Korean Intellectual Property Office, the disclosure of which are incorporated herein by reference in its entirety.

TECHNICAL FIELD

The following disclosure relates to a multi-sensor signal processing system for detecting a user's walking intent, a walking supporting apparatus comprising the system and a method for controlling the apparatus, and in particular, to a multi-sensor signal processing system for detecting a walking intent of a user who has difficulty in walking such as a paraplegia patent, a walking supporting apparatus comprising the system, and a method for controlling the apparatus.

The present invention is derived from research conducted by the Korea Research Council for Industrial Science & Technology [Project Management No.: 2008-PS-1-0004, Project title: Multi-Bio/Dynamics Sensor Convergence Technology].

BACKGROUND

With the advent of the era of aging population, the number of handicapped people such as those suffering from stroke or paralysis is growing. Thus, demand for self-reliance or self-support such as having a meal, wearing clothes or taking off the clothes, or the like, and walking in daily life of the handicapped is increasing in the rehabilitation industry, research on the field of a rehabilitation robot for the handicapped has been actively ongoing worldwide since 2000.

The rehabilitation robot technology field is in need of development of a bio-sensor that is able to detect a user's intent such as a walking intent and securing of a technique of controlling the bio-sensor, and in line with this, various bio-signal processing techniques are studied and developed. However, a bio-signal processing technique developed so far is yet to properly detect a user's walking intent and walking stages in real time.

SUMMARY

In one general aspect, a multi-sensor signal processing system for driving a left motor supporting walking of a left foot and a right motor supporting walking of a right foot, includes: a wireline/wireless communication unit receiving a first sensor signal corresponding to a force applied to a left palm, a second sensor signal corresponding to a force applied to a right palm, a third sensor signal corresponding to a force applied to a left sole, and a fourth sensor signal corresponding to a right sole in real time through one of a wireline communication scheme and a wireless communication scheme; a sensor information processing unit receiving the first to fourth sensor signals, comparing the size of the first and second sensor signals with a pre-set threshold value to analyze a user's walking intent, and outputting a first walking intent signal in response to the third sensor signal and outputting a second walking intent signal in response to the fourth sensor signal when the user's walking intent is checked; and a controller generating a first driving signal in response to the first walking intent signal to drive the left motor and generating a second driving signal in response to the second walking intent signal to drive the right motor.

In another general aspect, a walking supporting apparatus includes: a palm sensor unit detecting a force applied to a palm through a stick to generate a palm sensor signal and a sensor unit detecting a force applied to a sole through the ground to generate a sole sensor signal; a portable information processing unit checking a user's walking intent by using the palm sensor signal, and generating a driving signal in response to the sole sensor signal when it is checked that there is a walking intent; and a walking supporting mechanism including a left motor attached to a user's left leg and a right motor attached to a user's right leg and supporting the user's walking as the left motor and the right motor are driven in response to the driving signal.

In another general aspect, a method for controlling a walking supporting apparatus includes: detecting a force applied to a palm through a stick to generate a palm sensor signal and detecting a force applied to a sole through the ground to generate a sole sensor signal; comparing the size of the palm sensor signal with a pre-set threshold value to determine a user's walking intent; when it is checked that there is a walking intent, generating a driving signal in response to the sole sensor signal; and driving a motor of the walking supporting apparatus put on a user's lower body in response to the driving signal.

According to an exemplary embodiment, a user's walking intent is detected in real time by using a sensor signal detected by a palm sensor unit that detects a force applied to a palm, and when the user's walking intent is detected, a user's walking stage can be detected in real time by using a sensor signal detected by a sole sensor unit that detects a force applied to a sole.

Other features and aspects will be apparent from the following detailed description, the drawings, and the claims.

BRIEF DESCRIPTION OF THE DRAWINGS

FIGS. 6(*a*) and 6(*b*) are views for explaining a process of controlling a walking supporting mechanism by a controller illustrated in FIG. 2.

DETAILED DESCRIPTION OF EMBODIMENTS

Figure 1A:
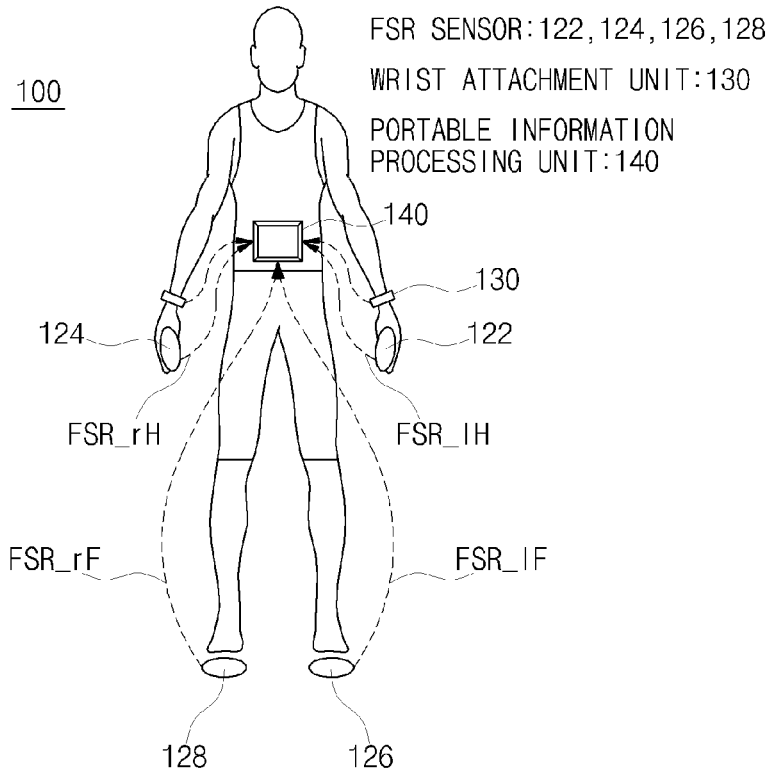
FIGS. 1(*a*) and 1(*b*) show a multi-sensor signal processing system and a walking supporting mechanism according to an exemplary embodiment.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 1B:
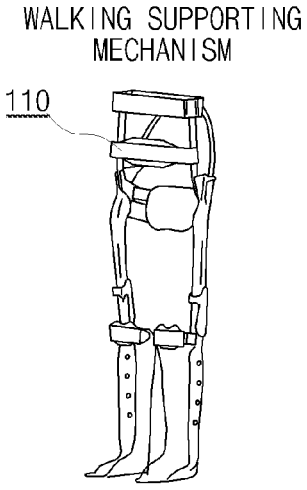

FIG. 1(*a*) shows the overall configuration of a multi-sensor signal processing system according to an exemplary embodiment. FIG. 1(*b*) shows a walking supporting mechanism 110 driven by the multi-sensor signal processing system 100 shown in FIG. 1(*a*). Although illustrated separately, in an embodiment, the walking supporting mechanism 110 may be included in the multi-sensor signal processing system 100.

With reference to FIG. 1 (*a*), a multi-sensor signal processing system 100 according to an exemplary embodiment includes first Force Sensing Resistor (FSR) sensor units 122, 124, 126, and 128, a wrist attachment unit 130, and a portable information processing unit 140. Also, a walking supporting mechanism 110 driven under the control of the multi-sensor signal processing system is illustrated in FIG. 1 (*b*) .

The first to fourth FSR sensor units 122, 124, 126, and 128, each having an FSR sensor, are attached to a user's palm and sole in order to detect a walking intent and walking stage of a user who has difficulty in walking. Each FSR sensor outputs different sizes of voltages as output values according to variation of a resistance value. These output values are transferred to the portable information processing unit 140.

The wrist attachment unit 130, attached to a user's wrist, is a module for transferring information indicating that the user starts walking and information indicating that the user stops walking to the portable information processing unit 140.

The portable information processing unit 140 analyzes the user's walking intent and walking stage by using the information transferred from the first to fourth FSR sensor units 122, 124, 126, and 128 and the wrist attachment unit 122. This will be described in detail later with reference to FIG. 2.

In order to drive the walking supporting mechanism 110 allowing for a user who is physically challenged, such as a paraplegia patent, to walk, the multi-sensor signal processing system 100 analyzes the forces applied to the user's hands and feet and detects the user's walking intent and walking stage based on the analysis results. Here, the expression 'detection of user's walking intent' refers to a detection whether or not the user wants to start walking or wants to stop walking or refers to how the user's left foot and right foot move.

In order to detect the user's walking intent, the multi-sensor signal processing system 100 analyzes a walking start signal (WM-on) and a walking stop signal (WM-off) outputted from the wrist attachment unit 130 and first to fourth FSR sensor signals (FSR_lH, FSR_rH, FSR_lF, FSR_rF) outputted, respectively, from the first to fourth FSR sensor units 122, 124, 126, and 128 attached to the user's left and right palms and left and right soles, and recognizes the user's walking intent based on the analysis results.

When the user's walking intent is recognized through the analysis results, the portable information processing unit 140 generates a driving signal for driving a power unit such as a motor mounted at the walking supporting mechanism 110. The power unit mounted at the walking supporting mechanism 110 starts driving to help the user walk in response to the generated driving signal.

Figure 2:
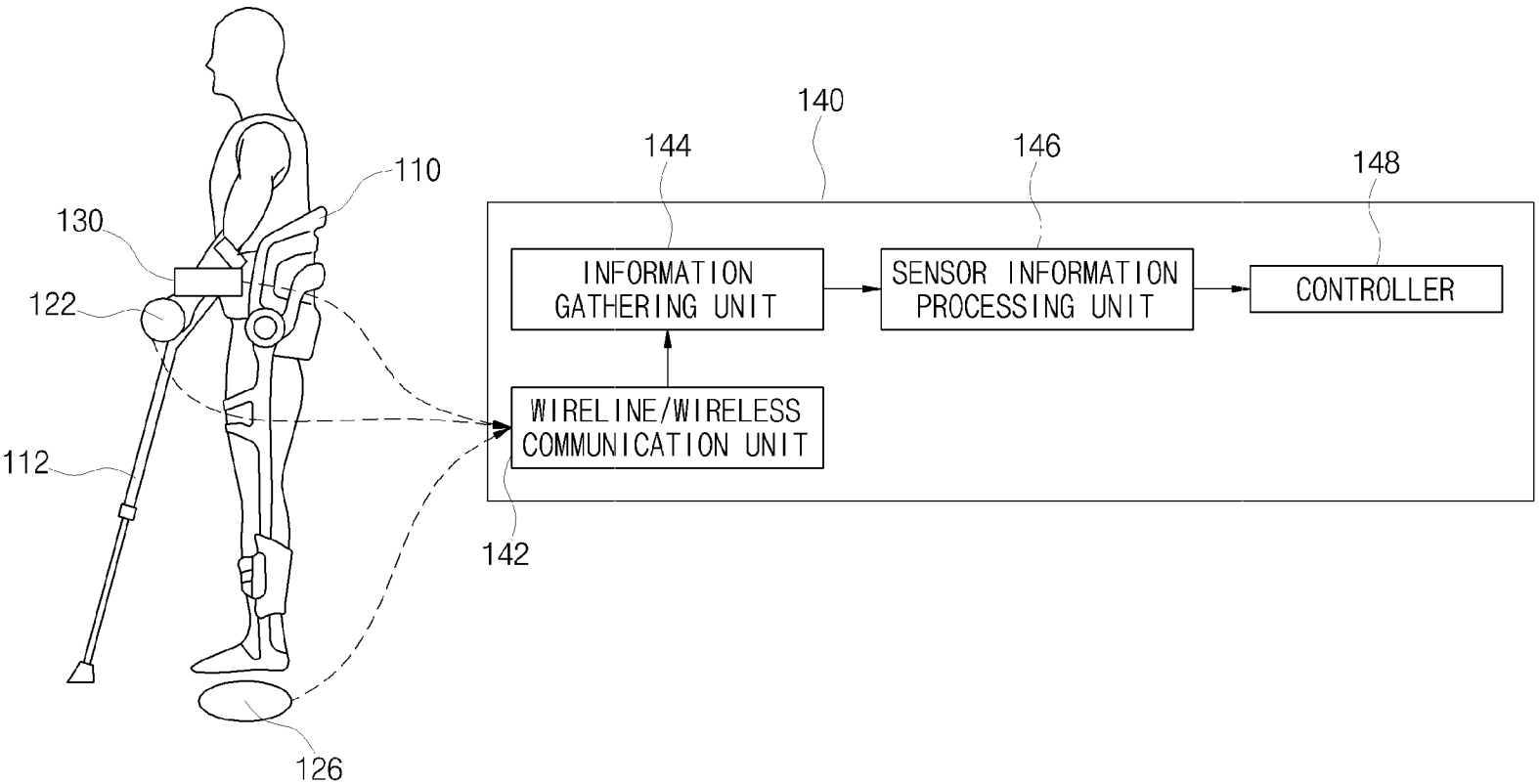
FIG. 2 is a block diagram showing an internal configuration of a portable information processing unit illustrated in FIG. 1.

FIG. 2 is a block diagram showing an internal configuration of a portable information processing unit illustrated in FIG. 1(*a*). In FIG. 2, the user equipped with the multi-sensor signal processing system illustrated in FIG. 1 is viewed from the left side, so the second and fourth FSR sensors 124 and 128 are not shown.

With reference to FIG. 2, when the user places a stick 112 on the ground while walking with the stick 112, a force applied to the user's palm through a handle part of the stick 112 and a force of weight applied to the sole are detected by the first to fourth FSR sensors 122, 124, 126, and 128. The detected units of information are then transferred to the portable information processing unit 140 according to a wireline or wireless communication scheme.

The portable information processing unit 140 comprises a wireline/wireless communication unit 142, an information gathering unit 144, a sensor information processing unit 146, and a controller 148 in order to analyze the detected units of information to recognize the user's walking intent and walking stage.

The wireline/wireless communication unit 142 receives the first to fourth sensor signals (FSR_lH, FSR _rH, FSR_lF, FSR_rF) detected, respectively by the first to fourth FSR sensor units 122, 124, 126, and 128 and the walking start signal WM-on and the walking stop signal WM-off detected by the wrist attachment unit 130 in real time according to wireline or wireless communication scheme and transfers the same to the information gathering unit 144. The wireline/wireless communication unit 142 receives sensing signals from the first to fourth FSR sensor units 122, 124, 126, and 128 according to a wireline/wireless communication scheme and transmits the same to the information gathering unit 144. Here, when the wireline/wireless communication unit 142 receives the units of sensor information according to a wireless communication scheme, a wireless communication scheme such as ZigBee™ may be used.

The information gathering unit 144 gathers the received first to fourth sensor signals (FSR_lH, FSR_rH, FSR_lF, FSR _rF) in real time and transfers the gathered signals to the sensor information processing unit 146.

The sensor information processing unit 146 analyzes the sensor signals gathered in real time from the information gathering unit 140 to calculate the size of the force (or pressure) applied to the user's palm and sole, and generates a user walking intent signal based on the calculation results. In this case, the sensor information processing unit 146 checks the location of the forces applied to the respective points of the user's sole and outputs a plurality of walking intent signals according to the check results. Namely, the sensor information processing unit 146 may output a plurality of different walking intent signals according to a sensor signal corresponding to an outer corner part of the foot, a sensor signal corresponding to a tiptoe, a sensor signal corresponding to the sole, and a sensor signal corresponding to a heel.

The controller 148 generates driving signals for driving the walking supporting mechanism 110 in response to the walking intent signals, and transfers the driving signals to the walking supporting mechanism 110.

The walking supporting mechanism 110 drives the motor in response to the driving signals, thereby helping the user who has difficulty in walking such as a paraplegia patent. In particular, the controller 148 transmits a plurality of different driving signals to the walking supporting mechanism 110 according to the plurality of different walking intent signals to drive the motor included in the walking supporting mechanism 110 according to walking stages described with reference to FIG. 4.

Figure 3:
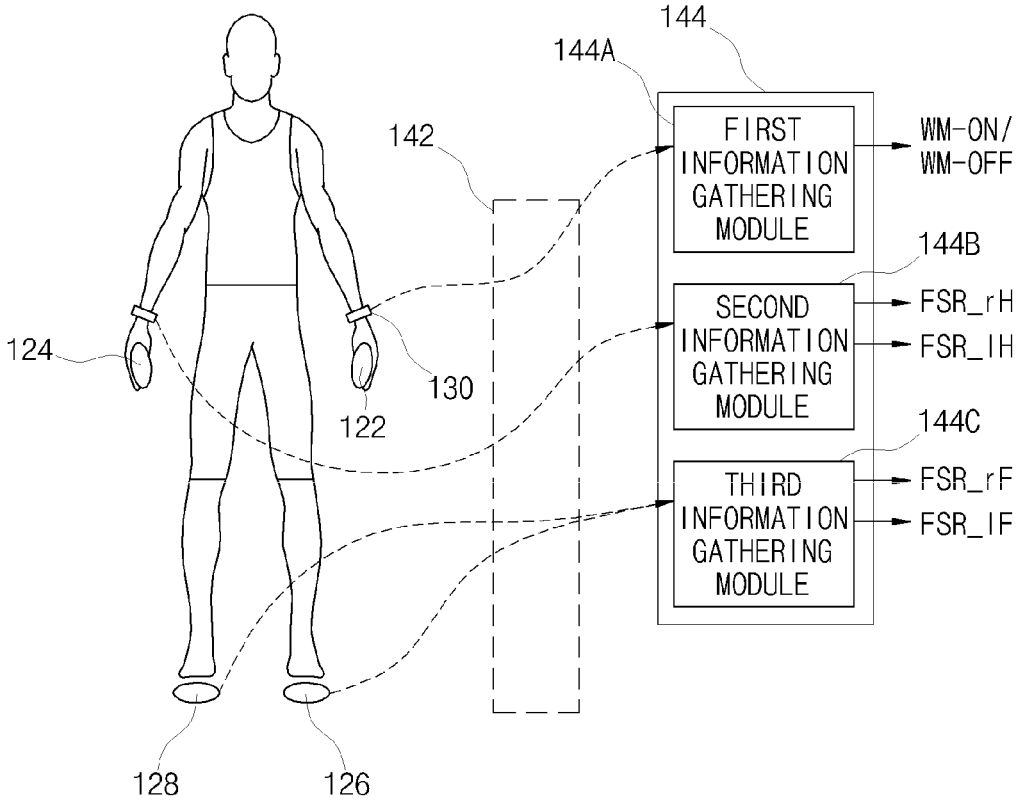
FIG. 3 is a block diagram of an information gathering unit illustrated in FIG. 2.

FIG. 3 is a block diagram of an information gathering unit illustrated in FIG. 2.

As shown in FIG. 3, the information gathering unit 144 included in the portable information processing unit 140 gathers the first to fourth (FSR_lH, FSR_rH, FSR_lF, FSR_rF) transferred through the wireline/wireless communication unit 142 and the information outputted from the wrist attachment unit 130. To this end, the information gathering unit 144 includes first to third information gathering modules 144A, 144B, and 144C.

The first information gathering module 144A receives a walking signal including a walking start signal (WM_on : Walking_Mode on) and a walking stop signal (WM_off : Walking_Mode off), which have been generated by the wrist attachment unit 130, through the wireline/wireless communication unit 142, to gather them The wrist attachment unit 130, including a user input unit such as a button (not shown) or the like, generates the walking start signal (WM_on : Walking_ Mode on) indicating starting of walking and the walking stop signal (WM_off : Walking_Mode off) indicating stopping of walking according to a user's button pressing operation.

The second information gathering module 144B receives the first and second sensor signals (FSR_lH, FSR_rH) generated by the first FSR sensor unit 122 attached to the user's left palm and the second FSR sensor 124 attached to the user's right palm, respectively, to gather them.

The third information gathering module 144C receives the third and fourth sensor signals (FSR_lF, FSR_rF) generated by the third FSR sensor unit 126 attached to the user's left sole and the fourth FSR sensor 128 attached to the user's right sole, respectively, to gather them. The third and fourth sensor signals (FSR_lF, FSR_rF) are sensor information measured from the sole, and the size information of the force applied to the user's sole when the user (i.e., the patient) steps on the ground with his foot in walking can be represented in the form of a voltage value. These signals (FSR_lF, FSR_rF) are used as information for detecting a walking stage of the user.

The first to third information gathering modules 144A, 144B, and 144C may be implemented as a digital electronic circuit, or the like, such as a buffer or a register that temporarily stores data and output them.

Figure 4:
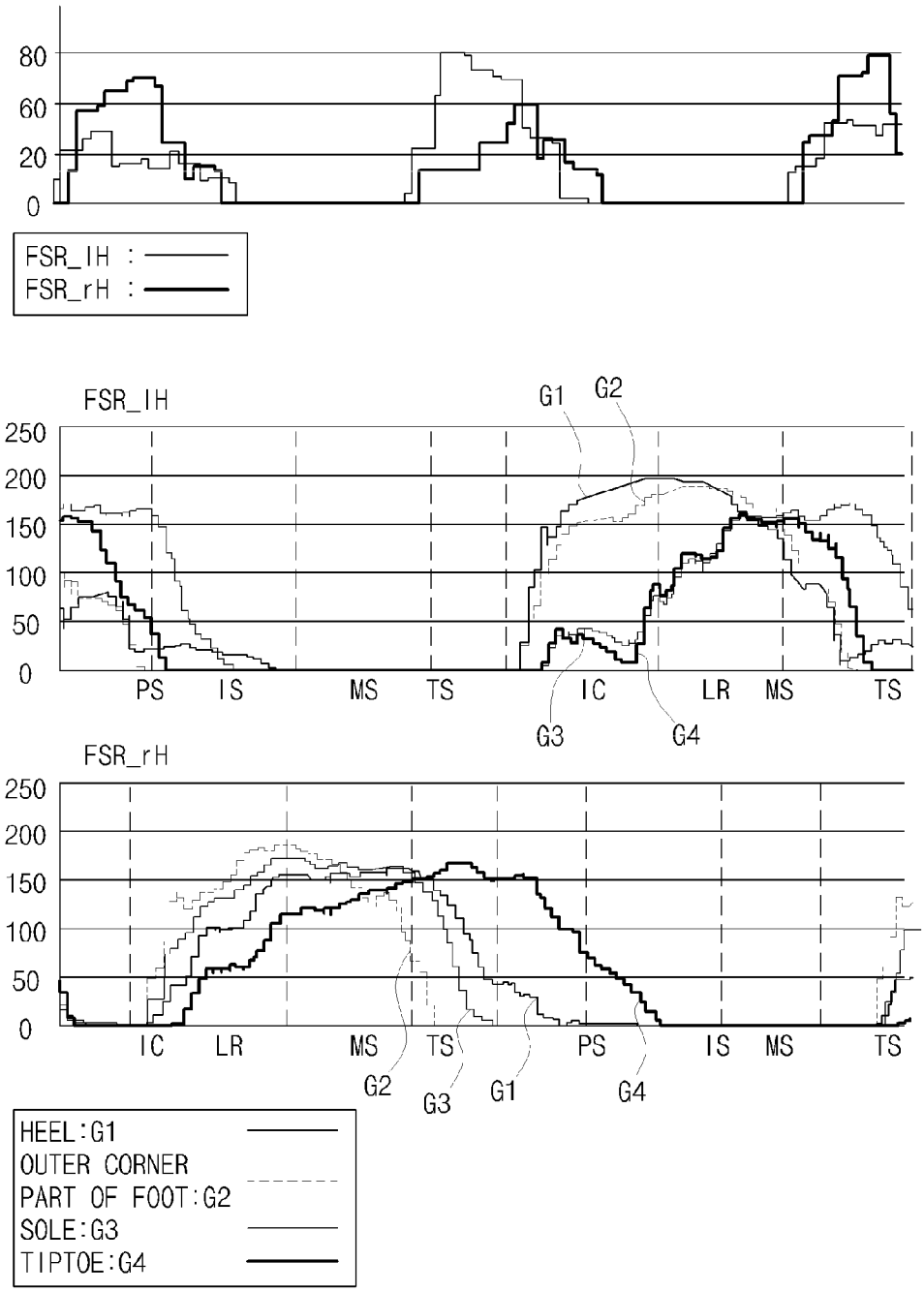
FIG. 4 shows waveforms of first to fourth sensor signals gathered by the information gathering unit illustrated in FIG. 3.

FIG. 4 shows waveforms of first to fourth sensor signals gathered by the information gathering unit illustrated in FIG. 3, for explaining walking stages of the user with the first to fourth sensor signals. FIG. 3 will be also referred to along with FIG. 4 to help understand the explanation.

With reference to FIGS. 3 and 4, first, when the user stops walking, namely, when the first information gathering module 144A in FIG. 3 gathers the walking stop signal (WM_off) from the wrist attachment unit 130, both the third and fourth sensor signals (FSR_lF, FSR_rF) detected from the user's both soles are gathered.

Thereafter, when the user starts walking with his right foot, namely, when the first information gathering module 144A starts to gather the walking start signal (WM_on), the start of walking is detected through the fourth sensor signal FSR_rF detected from the user's right heel. Namely, in a state that receiving of the fourth sensor signal (FSR_rF) from the fourth FSR sensor unit 128 attached to the user's right sole is stopped or rapidly reduced (i.e., a state in which the user's right foot is up in the air), when the fourth sensor signal (FSR_rF) is received again, the start of walking is detected. In this case, the fourth sensor signal (FSR_rF) may include a right foot heal signal detected when the user's right heel comes in contact with the ground, a right sole signal detected when the user's right sole comes in contact with the ground in a state in which the user's right heel is in contact with the ground, a right outer corner part signal detected when the right outer corner part of user's foot comes in contact with the ground in a state in which the user's right heel and right sole are in contact with the ground, and a right tiptoe signal detected when the right tiptoe comes in contact with the ground. Likewise, the third sensor signal (FSR_lF) corresponding to the user's left foot may include a left heel signal, a left sole signal, a left outer corner part signal, and a left tiptoe signal.

The walking stages of the user may include a total of eight stages: an Initial Contact (IC), a Loading Response (LR), a Mid Stance (MS), a Terminal Stance (TS), a Pre-Swing (PS), an Initial Swing (IS), an Mid-Swing (MS), and a Terminal Swing (TS).

The IC is a point of time at which the user's right heel starts to come in contact with the ground.

In the LR, the fourth sensor signal (FSR rF) including the entire right foot signals, namely, the heel signal, the sole signal, the right outer corner part signal, and the tiptoe signal, starts to appear from the fourth FSR sensor unit 128 attached to the user's right sole. In this case, the third sensor signal, namely, the entire left foot signals, received from the third FSR sensor unit 126 attached to the left sole disappears.

In the MS, the entire right foot signals increase up to almost as high as a maximum level, and at this time, the entire left foot signals, namely, the third sensor signal (FSR_lF), disappear.

In the TS, the right heel signal included in the fourth sensor signal (FSR_rF) disappears, and the left heel signal included in the third sensor signal (FSR_lF) appears.

In the PS, all the signals included in the fourth sensor signal (FSR_rF), excluding the right tiptoe signal, disappear, and the third sensor signal (FSR_lF) including the entire left foot signals, namely, the left tiptoe signal, the left sole signal, the left outer corner signal, the left tiptoe signal, appear.

In the IS, the entire right foot signals, namely, all the signals included in the third sensor signal (FSR_rF), disappear, and the entire left foot signal (FSR_lF) increases.

In the MS, the entire right foot signals (FSR_rF) do not exist, and all the signals included in the third sensor signal (FSR_lF) reach the maximum level.

In the TS, the right heel signal included in the fourth sensor signal (FSR_rF) appears again and, at the same time, the left heel signal (FSR_lF) included in the third sensor signal (FSR_lF) disappears.

Figure 5:
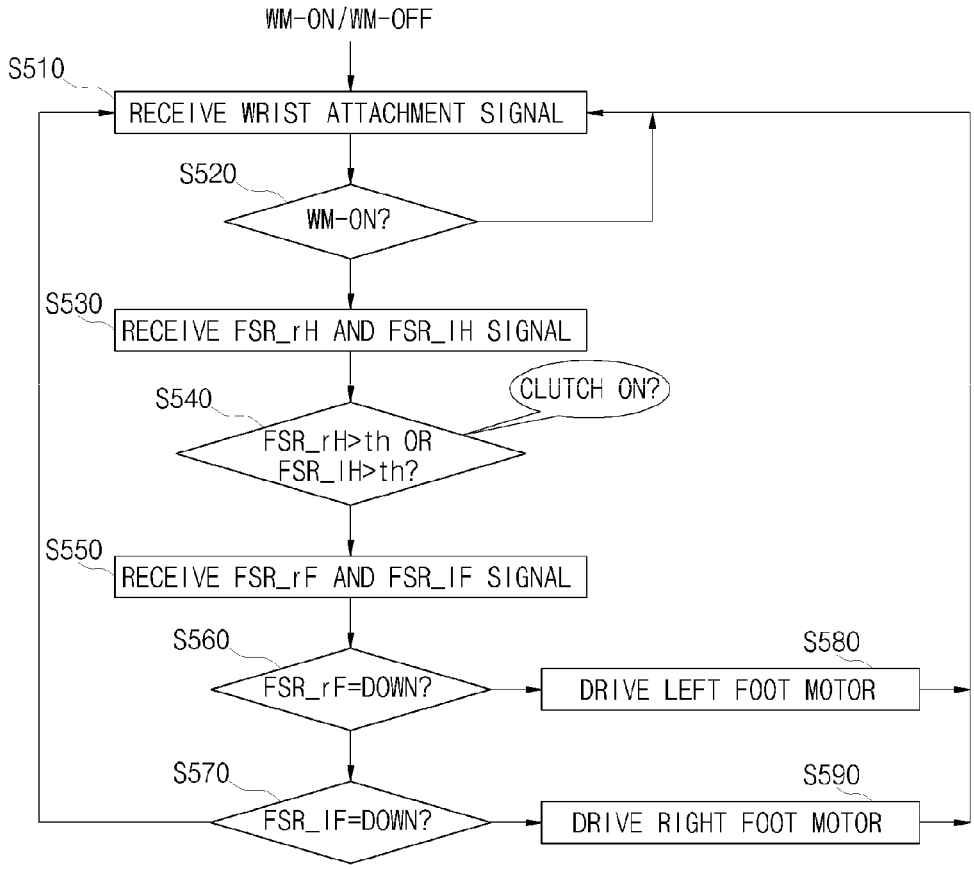
FIG. 5 is a flow chart illustrating the process of recognizing, by a sensor information processing unit illustrated in FIG. 2, a user's walking intent by using the information gathered by the information gathering unit.

FIG. 5 is a flow chart illustrating the process of recognizing, by a sensor information processing unit illustrated in FIG. 2, a user's walking intent by using the information gathered by the information gathering unit. To help understand the explanation, FIG. 2 will be referred to together.

With reference to FIGS. 5 and 2, first, a walking signal from the wrist attachment unit 130 is received by the sensor information processing unit 146 via the information gathering unit 144 (S510).

When the received walking signal is a walking start signal (WM_on) (S520), the first and second sensor signals (FSR_lH, FSR_rH) from the first and second FSR sensor units 122 and 124 are received by the sensor information processing unit 146 via the information gathering unit 144 (S530). The sensor information processing unit 146 analyzes the received first and second sensor signals (FSR_lH, FSR_rH).

Next, when the size of the first sensor signal (FSR_lH) or the second sensor signal (FSR_rH) corresponding to the user's palm is greater than a pre-set threshold value (th) according to the analysis result, the third and fourth sensor signals (FSR_lF, FSR_rF) corresponding to the user's sole are received, and the received third and fourth sensor signals (FSR_lF, FSR_rF) are analyzed by the sensor information processing unit 146. Namely, when the first sensor signal (FSR_lH) or the second sensor signal (FSR_rH) is greater than the pre-set threshold value, it means that the user applies a force to the stick 112, and thus, the third and fourth sensor signals (FSR_lF, FSR_rF) starts to be analyzed for the user's walking.

If the user's right sole comes in contact with the ground, the sensor information processing unit 146 analyzes a signal received via the information gathering unit 144, and if the received signal is analyzed to be the third sensor signal (FSR_lF) (S560), the sensor information processing unit 146 recognizes that the user wants to walk on his left foot and transfers the recognition result as a walking intent signal to the controller 148. Here, the walking intent signal includes a first walking intent signal indicating the user's intent to walk on his left foot and a second walking intent signal indicating the user's intent to walk on his right foot. Thus, if the received signal is the third sensor signal (FSR_lF) (S570), the sensor information processing unit 146 outputs the first walking intent signal to the controller 148, and when the received signal is the fourth sensor signal (FSR_rF) (S570), the sensor information processing unit 146 outputs the second walking intent signal to the controller 148.

And then, the controller 148 transmits a driving signal for driving the motor mounted in the walking supporting mechanism 110 to the walking supporting mechanism 110 according to a wireline/wireless communication scheme in response to the walking intent signal. The driving signal includes a first driving signal for driving a left foot motor installed near the user's left foot and a second driving signal for driving a right foot motor installed near the user's right foot. Namely, the controller 148 generates the first driving signal in response to the first walking intent signal and the second driving signal in response to the second walking intent signal. The generated first and second driving signals are transmitted to the walking supporting mechanism, the left foot motor installed in the walking supporting mechanism is driven in response to the first driving signal (S580), and the right foot motor is driven in response to the second driving signal (S590).

Meanwhile, when the sensor information processing unit 146 receives the walking stop signal (WM_off), it analyzes that the user does not have a walking intent, generates an end signal and transfers the generated end signal to the controller 148 in response to the walking stop signal (WM_off). The controller then generates a driving stop signal and transmits it to a corresponding motor in response to the end signal, and the motor, upon receiving the driving stop signal, stops its driving.

The operations S510, S520, S530, S540, S550, S560, S570, S580, and S590 described so far are repeatedly performed until such time as the walking stop signal (WM_off) is inputted to the sensor information processing unit.

FIGS. 6 (*a*) and 6(*b*) are views for explaining a process of controlling a walking supporting mechanism by a controller illustrated in FIG. 2. FIG. 6(*a*) illustrates a process of controlling a walking supporting mechanism when a walking start signal (WM on) is received. FIG. 6(*b*) illustrates a process of controlling a walking supporting mechanism when a walking stop signal (WM off) is received.

With reference to FIGS. 6 (*a*) and 6(*b*), the operation of controlling the walking supporting mechanism includes first to fourth operations. In the first operation (SW; SWing), the user raises his foot in the air. In the second operation (HS: Heel Strike), the user's heel comes in contact with the ground. In the third operation (FF: Foot Flat), the user's sole comes entirely in contact with the ground. In the fourth operation (HO: Heel Off), the user's heel is released from the ground.

Before the user starts to walk (WM_off), the sensor signals (FSR_lF, FSR_rF) of the user's both feet are sensed from every point of the sole, namely, from the point of heel, from the point of outer corner part of the foot, from the point of the sole, and from the point of the tiptoe. Thus, the third and fourth FSR sensor units 126 and 128 attached to the user's both feet include a sensor attached to the heel, a sensor attached to the outer corner part of the foot, a sensor attached to the sole, and a sensor attached to the tiptoe.

The walking supporting mechanism 110 drives the motor handling (or in charge of) the user's right foot to raise the heel of the user's right foot while bending the user's hip joint and knee joint (HO). In this case, the right foot motor raises the right foot until such time as the fourth sensor signal (FSR_rF) corresponding to the right foot disappears, while keeping bending the hip joint and knee joint (SW). When the fourth sensor signal (FSR_rF) disappears, the right foot motor stretches out the hip joint and the knee joint to allow the right foot heel to come in contact with the ground (HS) and then shifts the center of gravity to the right to allow the entire sole of the right foot to come in contact with the ground (FF). Thereafter, as the left foot motor is driven, the heel of the left foot is raised (HO).

The left foot motor is driven to raise the user's left foot until such time as the third sensor signal (FSR_lF) disappears (SW), and when the third sensor signal (FSR_lF) disappears, the left foot motor stretches out the hip joint and the knee joint to allow the user's leg to come in contact with the ground (HS). At the same time, the left foot motor shifts the center of gravity to the left to allow the entire sole of the left foot to come in contact with the bottom surface (FF), and then, the right foot motor is driven to raise the heel of the right foot (HO). This process is continuously repeated until such time as the portable information processing unit 140 receives the walking stop signal (WM_off) from the wrist attachment unit 130.

When the portable information processing unit 140 receives the walking stop signal (WM_off), the controller 148 of the portable information processing unit 140 enables the user to raise his right foot or left foot (SW), while he is walking (WM_on), and stretch out the foot only by a half of the angle, at which the hip joint and the knee joint is stretched out, to take a step on the bottom surface (or the ground) (FF), so that the foot can be positioned at the same point as that of the other foot being supported.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A multi-sensor signal processing system for driving a left motor supporting walking of a left foot and a right motor supporting walking of a right foot, the system comprising:

a communication unit configured to receive a first sensor signal corresponding to a force applied to a left palm, a second sensor signal corresponding to a force applied to a right palm, a third sensor signal corresponding to a force applied to a left sole, and a fourth sensor signal corresponding to a force applied to a right sole, in real time through one of a wireline communication method and a wireless communication method;

a sensor information processing unit configured to receive the first to fourth sensor signals, compare a size of any of the first and second sensor signals with a pre-set threshold value to determine if there is a walking intent, and output a first walking intent signal in response to the third sensor signal and output a second walking intent signal in response to the fourth sensor signal when it is determined that there is a walking intent; and a controller configured to generate a first driving signal in response to the first walking intent signal to drive the left motor and generate a second driving signal in response to the second walking intent signal to drive the right motor.

2. The system of claim 1, further comprising:

a first sensor unit configured to be coupled to the left palm and configured to output an amount of voltage as the first sensor signal, the amount of voltage varying according to the force applied to the left palm;

a second sensor unit configured to be coupled to the right palm and configured to output an amount of voltage as the second sensor signal, the amount of voltage varying according to the force applied to the right palm;

a third sensor unit configured to be coupled to the left sole and configured to output an amount of voltage as the third sensor signal, the amount of voltage varying according to the force applied to the left sole; and a fourth sensor unit configured to be coupled to the right sole and configured to output an amount of voltage as the fourth sensor signal, the amount of voltage varying according to the force applied to the right sole.

3. The system of claim 2, wherein each of the first to fourth sensor units comprises a Force Sensing Resistor (FSR) configured to generate a resistance value corresponding to the force applied to the respective sensor unit, and output the amount of voltage, the amount of voltage varying according to the resistance value.

4. The system of claim 2, wherein each of the first and second sensor units is configured to output the first and second sensor signals, respectively, according to the force applied to the left palm and the right palm by a stick.

5. The system of claim 4, further comprising:

a wrist attachment unit configured to attach to a user's wrist, and configured to generate a walking start signal and a walking stop signal according to a user manipulation and transmit the generated walking start signal and the walking stop signal to the communication unit according to one of the wireline communication method and the wireless communication method.

6. The system of claim 5, wherein the sensor information processing unit analyzes the user's walking intent after receiving the walking start signal.

7. The system of claim 5, wherein after the walking start signal is received, if one of the first and second sensor signals is greater than the pre-set threshold value, the sensor information processing unit determines that the user has a walking intent.

8. The system of claim 5, wherein when the walking stop signal is received, the sensor information processing unit determines that the user does not have a walking intent.

9. The system of claim 8, wherein the sensor information processing unit generates an end signal in response to the walking stop signal and transmits the generated end signal to the left motor and the right motor to stop driving of the left motor and the right motor.

10. A walking supporting apparatus comprising:

a palm sensor unit configured to detect a force applied to a palm through a stick to generate a palm sensor signal, and a sensor unit configured to detect a force applied to a sole through the ground to generate a sole sensor signal;

a portable information processing unit configured to check a user's walking intent by using the palm sensor signal, and generate a driving signal in response to the sole sensor signal when it is determined that there is a walking intent; and a walking supporting mechanism including a left motor configured to attach to a user's left leg and a right motor configured to attach to a user's right leg, wherein the walking supporting mechanism supports the user's walking as the left motor and the right motor are driven in response to the driving signal.

11. The apparatus of claim 10, wherein the portable information processing unit receives the palm sensor signal and the sole sensor signal according to one of a wireline communication method and a wireless communication method.

12. The apparatus of claim 11, further comprising:

a wrist attachment unit configured to attach to a user's wrist and configured to generate a walking start signal and a walking stop signal according to a user manipulation and transmit the generated walking start signal and the walking stop signal to the portable information processing unit according to one of the wireline communication method and the wireless communication method.

13. The apparatus of claim 12, wherein the portable information processing unit separately gathers the walking start signal, the walking stop signal, the palm sensor signal, and the sole sensor signal.

14. The apparatus of claim 13, wherein the portable information processing unit comprises:

a first information gathering module configured to gather the walking start signal and the walking stop signal;

a second information gathering module configured to gather the palm sensor signal; and a third information gathering module configured to gather the sole sensor signal.

15. The apparatus of claim 12, wherein the portable information processing unit receives the walking start signal, and if the size of the palm sensor signal is greater than a pre-set threshold value, the portable information processing unit determines that the user has a walking intent.

16. A method for controlling a walking supporting apparatus, the method comprising:

detecting a force applied to a palm through a stick to generate a palm sensor signal and detecting a force applied to a sole through the ground to generate a sole sensor signal;

comparing a size of the palm sensor signal with a pre-set threshold value to determine if there is a walking intent;

when it is determined that there is a walking intent, generating a driving signal in response to the sole sensor signal; and driving a motor of the walking supporting apparatus in response to the driving signal, wherein the walking supporting apparatus is configured to be worn on a user's lower body .

17. The method of claim 16, wherein the sole sensor signal comprises a heel signal corresponding to a heel part, an outer corner signal corresponding to an outer corner part of a foot, a sole signal corresponding to a sole part, and a tiptoe signal corresponding to a tiptoe part.

18. The method of claim 17, wherein, in generating a driving signal, a plurality of driving signals are generated according to the heel signal, the outer corner signal, the sole signal, and the tiptoe signal.

19. The method of claim 18, wherein the motor of the walking supporting mechanism is driven according to walking stages corresponding to the plurality of different driving signals.

20. The method of claim 16, further comprising:

generating a walking start signal and a walking end signal indicating starting or terminating walking, respectively, through a wrist attachment module, the wrist attachment module being configured to attach to the user's wrist, wherein when the size of the palm sensor signal is greater than the pre-set threshold value after the walking start signal is generated, it is determined that the user has intent to walk.

* * * * *